United States Patent [19]

Courson

[11] Patent Number: 4,488,631

[45] Date of Patent: Dec. 18, 1984

[54] BALUSTRADE

[75] Inventor: Iber C. Courson, Gettysburg, Pa.

[73] Assignee: Westinghouse Electric Corp., Pittsburgh, Pa.

[21] Appl. No.: 399,408

[22] Filed: Jul. 16, 1982

[51] Int. Cl.[3] ..... B66B 9/14

[52] U.S. Cl. ..... 198/335

[58] Field of Search ..... 198/335, 337, 338, 841

[56] References Cited

U.S. PATENT DOCUMENTS

| | | | |
|---|---|---|---|
| 2,632,550 | 3/1953 | Panter | 198/335 |
| 2,780,338 | 2/1957 | Tilton | 198/337 |
| 3,568,813 | 3/1971 | Schaeffer et al. | 198/335 |
| 3,623,590 | 11/1971 | Johnson | 198/337 |
| 4,358,010 | 11/1982 | Besch | 198/841 X |

FOREIGN PATENT DOCUMENTS

| | | | |
|---|---|---|---|
| 52-61087 | 5/1977 | Japan | 198/335 |
| 53-16289 | 2/1978 | Japan | 198/335 |
| 54-55987 | 5/1979 | Japan | 198/335 |

*Primary Examiner*—Robert J. Spar
*Assistant Examiner*—Jonathan D. Holmes
*Attorney, Agent, or Firm*—D. R. Lackey

[57] ABSTRACT

A balustrade mounted on a supporting truss. The balustrade includes a composite deck formed of a metallic base member having an upstanding edge for mounting a handrail guide member, and an upper member formed of plastic. The metallic base member and non-metallic upper member are fixed together to form a structural box beam. A plastic handrail guide member is fixed to the upstanding edge of the base member, with the base of the handrail guide member being channeled to receive the upper edges of the upstanding balustrade panels.

5 Claims, 6 Drawing Figures

BALUSTRADE

BACKGROUND OF THE INVENTION

1. Field of the Invention

The invention relates in general to balustrades, and more specifically to balustrades suitable for transportation apparatus.

2. Description of the Prior Art

Balustrades are provided on each side of moving walks and escalators, and a moving handrail is mounted on the top of each balustrade. When the balustrade is formed of glass panels, the upper edge of the glass supports the handrail guide, and the centerline of the handrail may be oriented directly over the center of the glass. The handrail is thus positioned closely adjacent to the moving portion of the walk or escalator. When the balustrade is formed of opaque panels, such as metal panels, an elaborate support structure must be provided to support the handrail guide and handrail, as well as to position and hold the opaque panels. The handrail guide thus does not end up over the centerline of the balustrade panels, requiring an inner upper deck to be provided between the handrail guide and balustrade panels.

It would be desirable to be able to locate the handrail guide directly over the opaque balustrade panels, to enable passengers to stand closer to the handrail. This would also eliminate the additional cost of the inner deck, and it would improve the appearance of the transportation apparatus. However, these objectives should be achieved without incurring offsetting additional cost due to the support arrangement resorted to in order to achieve the requisite mechanical strength.

The balustrades and handrail guides are relatively high cost structures, because they must be pleasing in appearance as well as rugged and reliable. These requirements usually necessitate the use of high cost materials, such as stainless steel. Thus, it would be desirable to be able to reduce the cost of the balustrades and hand rail guide structures, if the cost reductions can be achieved without sacrificing strength, dimensional stability and appearance.

The balustrade panels are frequently damaged, such as scratched or bent during usage, with replacement thereof being time consuming and therefore costly. Thus, it would be desirable to be able to quickly replace damaged balustrade panels, as well as to facilitate the installation of the panels at the time of field installation of the transportation apparatus.

The handrail guide is a costly composite structure, formed of metal with special low coefficient of friction strips interposed between the metal and the inside of the handrail. Thus, it would be desirable to be able to simplify and reduce the cost of the handrail guide, if this objective can be achieved without deleteriously effecting handrail life.

SUMMARY OF THE INVENTION

Briefly, the present invention is a new and improved balustrade for transportation apparatus, including a new and improved handrail guide and support structure. The intermediate portion of the new and improved balustrade, i.e., the portion between the newels, features a new and improved support structure in the form of an upper, outer deck which has high structural strength, and yet is easily field formed at the installation site to form gentle curves, such as between the incline and newels of an escalator. The new outer deck is in the form of a hollow, box-type beam, including a metallic base portion, which is concealed from view, and a nonmetallic plastic member, such as an extrusion, or a pultrusion, fixed to the base. The exterior surface of the plastic member includes a slightly recessed portion for receiving a thin sheet of decorative material, such as a metallic cladding, porcelain enamel, wood veneer, or plastic, as desired. The metallic base provides dimensional stability, and the box-type structural beam arrangement provides the required mechanical strength. The decorative laminate eliminates the need of making the whole exterior deck member of this material.

The inner edge of this compositely formed upper, outer deck terminates in an upstanding handrail guide support, formed by an integral extension of the metallic base member. The extension is continuous in the straight section of the apparatus, and it is provided with spaced slots which extend inwardly from the upper edge in the curved sections, to facilitate field forming of the curves.

Spring steel clips are disposed in spaced relation along the inner edge of the deck. The spring steel clips provide a continuous resilient pressure against the balustrade panels, when they are in assembled relation with the supporting structure.

The handrail guide is fastened to the handrail guide support, with the guide being channeled to receive the upstanding support. The spaced leg portions of the handrail guide which define the channel are dimensioned to extend to the top of the composite deck structure on one side, and to thus conceal the handrail guide support, and to provide a lip which overhangs the balustrade panels on the other side. The channel in the handrail guide support is dimensioned to allow each panel to be inserted into the channel, against the pressure of the spaced spring clips, and to enable the panel to be lifted high enough to swing its lower end over the lower panel support. The panel is then lowered into the lower support, with the channel legs still overlapping the upper edge of the panel. The spring clips maintain the panels tight and vibration-free.

New and improved newel sections complete each balustrade, with the newel sections continuing the desirable features of the intermediate portion of the balustrade. The newel sections are formed of a high strength plastic, such as reinforced fiberglass. Each newel section includes a recessed exterior surface for continuing the decorative strip of material, without interruption, from the intermediate portion of the balustrade. It further includes an integral, upstanding handrail guide support member, which smoothly continues the metallic handrail guide support of the intermediate section. A composite handrail guide, formed of metal and plastic, is fastened to the handrail guide support member, to smoothly continue the plastic handrail guide support of the intermediate section.

In a preferred embodiment of the invention, the handrail guide for the intermediate section, and the plastic portion of the newel section, is extruded of a self-lubricating plastic material which has a coefficient of friction selected to be low enough to enable the guide to directly contact the inside of the handrail. Ultrahigh molecular weight (UHMW) polyethylene is preferred.

BRIEF DESCRIPTION OF THE DRAWINGS

The invention may be better understood, and further advantages and uses thereof more readily apparent, when considered in view of the following detail description of exemplary embodiments, taken with the accompanying drawings in which.

DESCRIPTION OF PREFERRED EMBODIMENTS

Figure 1:
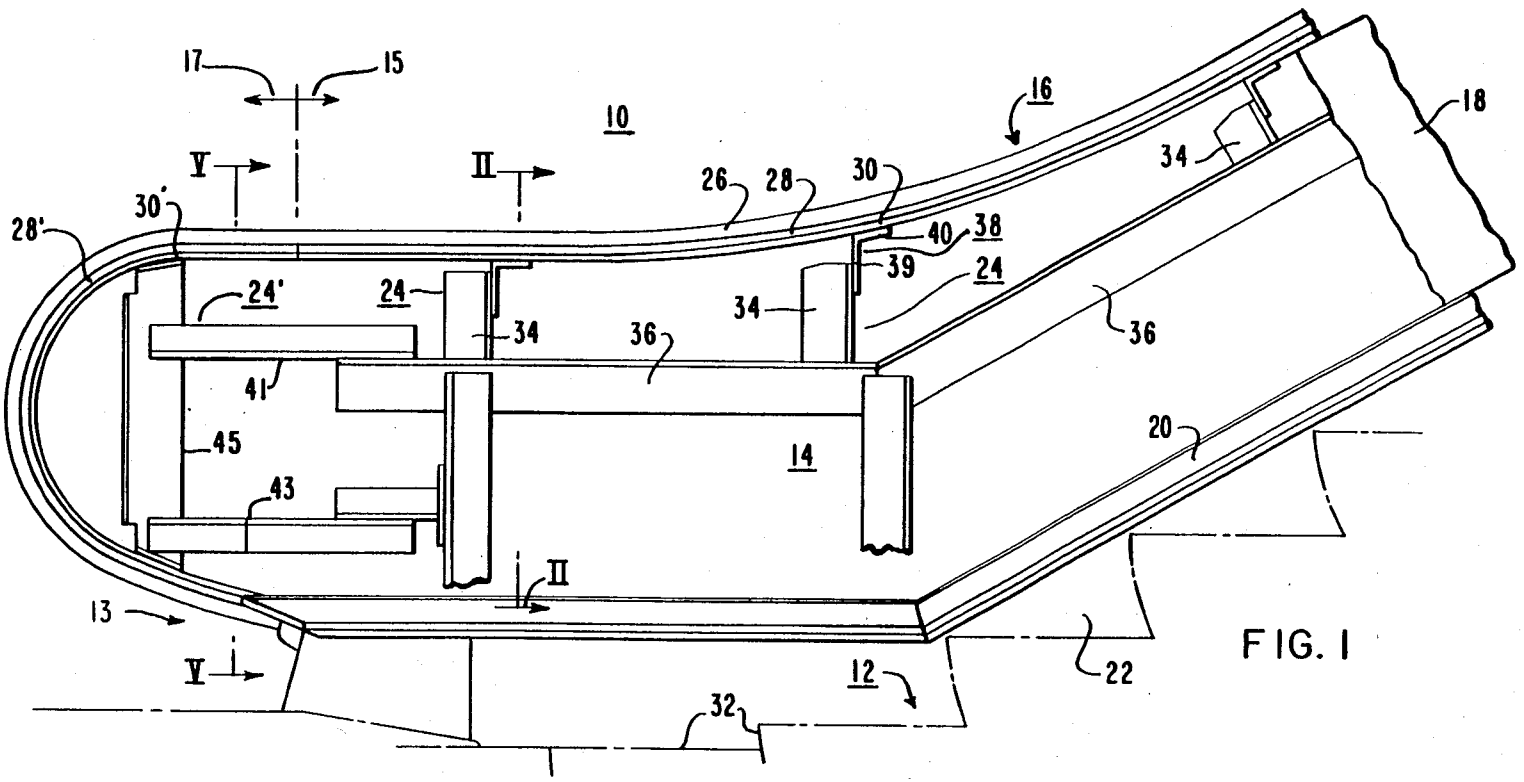
FIG. 1 is an elevational side view of transportation apparatus having a balustrade constructed according to the teachings of the invention.

Referring now to the drawings, and to FIG. 1 in particular there is shown a fragmentary view in side elevation of transportation apparatus 10 of the type which may utilize the teachings of the invention. Transportation apparatus 10 employs a conveyor 12 for transporting passengers between a first landing 13 and a second landing. Conveyor 12 is of the endless type conventionally used in moving walks and moving stairways or escalators. If the conveyor 12 is a moving walk, it may have a belt-type treadway, or a pallet-type. For purposes of example, it will be assumed that the conveyor 12 is in the form of an escalator or moving stairway, such as described in detail in U.S. Pat. Nos. 3,677,388; 3,682,289 and 3,707,220, which are assigned to the same assignee as the present application.

Conveyor 12, which is supported by a support structure or truss 14, includes an upper load bearing run on which passengers stand, and a lower return run. Balustrades are disposed on opposite sides of conveyor 12, with only the left-hand balustrade 16 being illustrated, as viewed from the lower landing 13. Balustrade 16 includes an intermediate section 15, a lower newel section 17, and an upper newel section which is not shown, because it is similar to the lower section 17. Balustrade 16 is of the opaque type, having a plurality of balustrade panels formed of a suitable material, such as metal or plastic. Each panel 18 has upper and lower edges 19 and 21, respectively. The panels 18 are aligned in end-to-end relation, to define a continuous sidewall adjacent to each side of the conveyor 12. The panels 18 extend downwardly to a lower inner deck 20, which extends to a skirt 22. Balustrade 16 is shown with most of the panels 18 removed, in order to more clearly illustrate the supporting structure.

A support structure 24 mounted on truss 14 supports a continuous, flexible handrail 26. Handrail 26 is guided over the upper portion of balustrade 16 by new and improved elongated handrail guide means having first and second portions 28 and 28', respectively, and handrail guide supporting means having first and second portions 30 and 30', respectively, to be hereinafter described.

Conveyor 12 includes a plurality of steps 32, only a few of which are illustrated in FIG. 1. The steps 32 are moved in a closed path, closely adjacent to the skirt 22 on each side of the conveyor 12. Conveyor 12 may be driven in a conventional manner, such as illustrated in U.S. Pat. No. 3,414,109, or the conveyor may be driven by a modular drive arrangement, as disclosed in the hereinbefore mentioned U.S. Pat. Nos. 3,677,388; 3,682,289 and 3,707,220. As disclosed in these three patents, the conveyor 12 includes an endless belt formed of toothed links (not shown) to which the steps 32 are connected. The endless belt and steps 32 are driven by a modular drive unit (not shown) which includes sprocket wheels and a drive chain for engaging the toothed links.

The support structure 24 which supports the intermediate section 15 of the balustrade 16 includes a plurality of spaced assemblies, each of which includes an upstanding vertical support channel 34 fixed to an upper truss cord 36, and an angle bracket 38 having first and second leg portions 39 and 40, respectively. Leg portion 39 is fixed to the channel 34, and leg portion 40 provides the support base for the handrail guide supporting structure 30. The support structure 24', which supports the newel section 17, includes upper and lower horizontally oriented channel members 41 and 43, respectively, which have ends fixed to truss 14, and a vertically oriented channel member 45 which is fixed to the remaining ends of the horizontal members 41 and 43.

Figure 2:
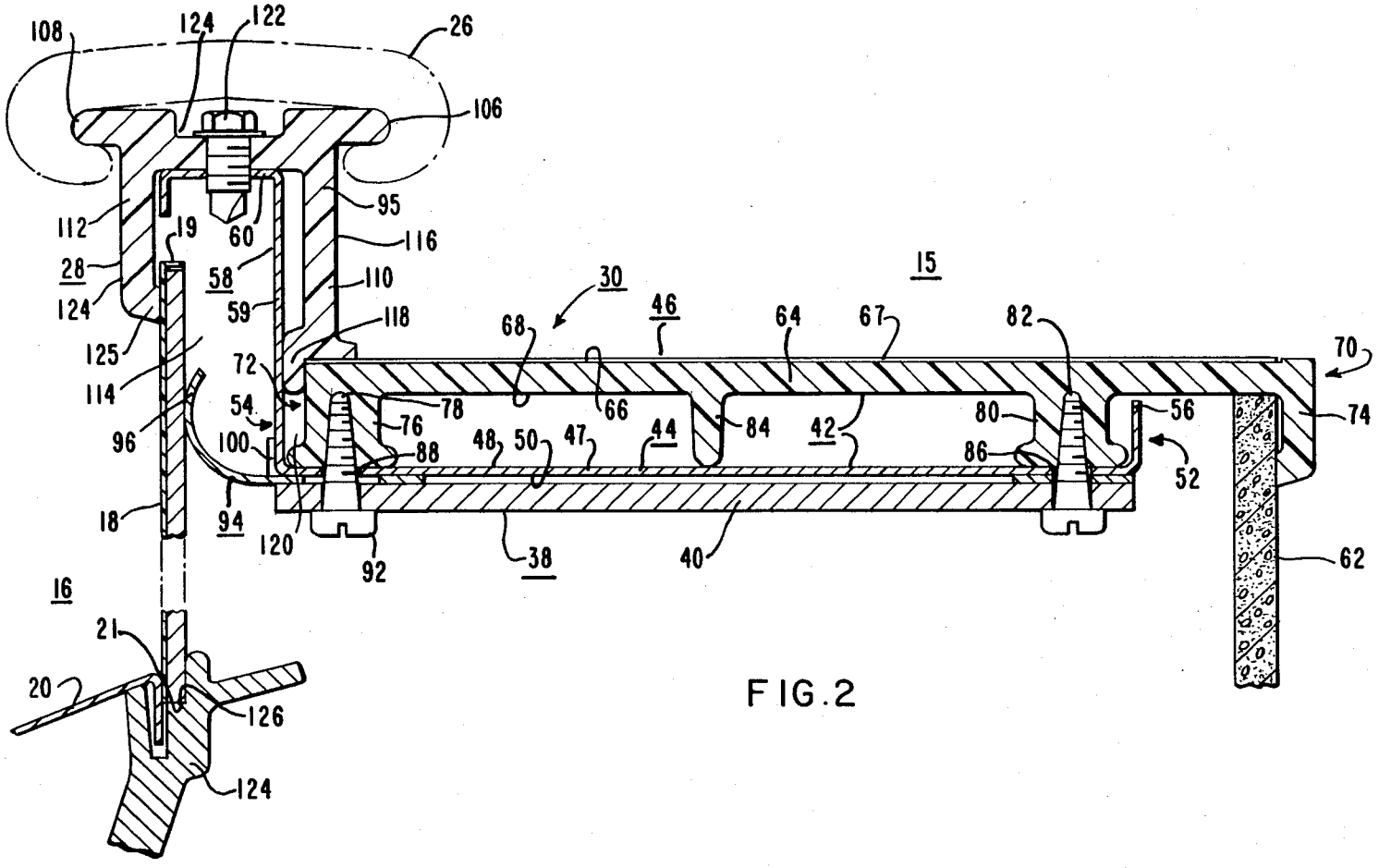
FIG. 2 is a cross-sectional view of an intermediate section of the balustrade shown in FIG. 1, taken between and in the direction of arrows II—II.
Figure 3:
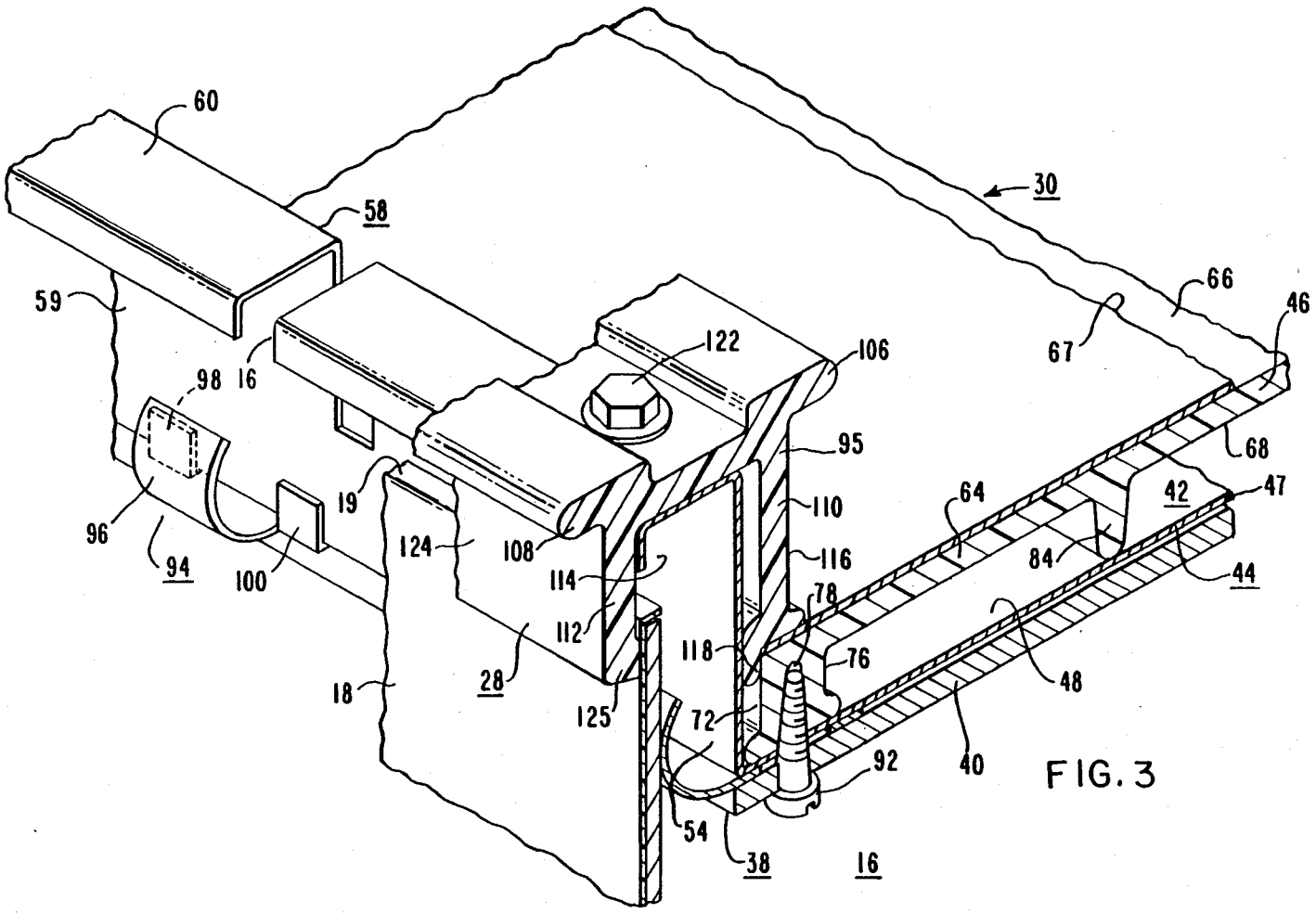
FIG. 3 is a perspective view, in section, of the balustrade shown in FIGS. 1 and 2.

FIG. 2 is a cross-sectional view taken between and in the direction of arrows II—II in FIG. 1, illustrating the intermediate section 15 of balustrade 16, which is constructed according to the teachings of the invention. FIG. 3 is a perspective view, in section, of the handrail guide support structure 30 and handrail guide 28. Both FIGS. 2 and 3 will be referred to interchangeably in the following detailed description of an exemplary embodiment of the invention.

More specifically, the intermediate section 15 of balustrade 16 includes the handrail guide support structure 30, which, in addition to supporting the handrail guide means 28, functions as an upper outer deck. Structure 30 includes a box-like beam or structural member 42 formed of an elongated metallic base member 44 and an elongated non-metallic upper deck member 46.

The base member 44 is formed of a strong metallic material, such as a 0.075 inch thick sheet of galvanized steel having a major portion 47 defined by parallel, opposed surfaces 48 and 50, and first and second lateral edges 52 and 54, respectively. The first lateral edge 52 may be turned upwardly from surface 48 to form an integral flange 56, to increase the stiffness of portion 47. The second lateral edge 54 is formed to define an integral, upstanding handrail guide support 58. Handrail guide support 58, which extends perpendicularly away from surface 48, has an inverted L-shaped cross-sectional configuration, including a stem portion 59 and a base portion 60, with the base portion 60 of the L-shape being parallel with portion 47. Spaced slots, such as slot 61 shown in FIG. 3, extend inwardly from base 60, to facilitate forming curved portions of handrail guide support 58.

The non-metallic upper deck member 46 is preferably an extrusion formed of a high strength plastic, such as A.B.S. plastic, or a pultrusion reinforced with glass. The color of deck member 46, such as black, is selected to provide the desired accent line between an end of the deck member and an adjacent wall portion 62, such as a dry wall panel. A glass reinforced pultrusion has excellent thermal stability. Deck member 46 includes a main section 64 having first and second major, opposed surfaces 66 and 68, respectively, and first and second lateral edges 70 and 72, respectively. The first edge 70 includes a right angle flange 74 which overlaps wall portion 62, and the second edge 72 defines a first depending leg portion 76 which has a channel 78 for receiving assembly screws. A second depending leg portion 80, which has a screw receiving channel 82, is disposed between the lateral edges 70 and 72. Additional depending portions, such as portion 84, may be provided to add strength and stiffness to the composite assembly. Surface 66 is recessed slightly, in order to receive a decorative laminate 67, such as a stainless steel or bronze cladding, or other suitable material, as hereinbefore described, which is applied and bonded with a suitable adhesive. The laminate 67 may be jointless from end to end, as it may be applied from a roll of sufficient length to extend from the top to the bottom of the escalator.

The metallic base member 44 includes a plurality of elongated, spaced slots 86 and 88 adjacent to its lateral edges for receiving assembly screws 90 and 92, respectively, which fix the metallic and non-metallic portions of the composite, hollow, box-type beam or deck structure together. The screws 92 extend through openings in the leg portion 40, when the assembly crosses the support angles 38, to firmly fix the assembly 30 to truss 14.

Figure 4:
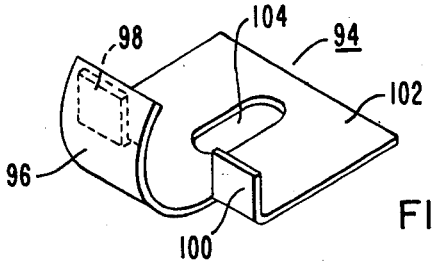
FIG. 4 is a perspective view of a spring clip, which is shown in cross-section in FIG. 2.

The screws 92 are also used to mount a plurality of spring clips 94, in spaced relation, with a spring clip 94 being shown in perspective in FIG. 4. These clips 94 are formed of a material such as galvanized, cold-rolled steel, and they have a curved, spring portion 96 which functions as a resilient panel retainer, as will be hereinafter explained. Additional projections 98 and 100 extend outwardly from a main mounting base portion 102, to accurately locate clip 94 along the second lateral edge 54 of the metallic base member 44. An opening 104 is formed in the spring clip to cooperate with the screws 92.

The first portion 28 of the handrail guide means includes an elongated non-metallic member 95 formed of a self-lubricating material having a coefficient of friction low enough to enable the inner surface of handrail 26 to make direct contact with guide means 28. Thus, the additional low coefficient of friction strips used in the prior art for contacting the inside of the handrail are eliminated. In a preferred embodiment, the material of member 95, of which the first portion of the handrail guide means 28 is formed, is an ultrahigh molecular weight (UHMW), high density polyethylene. The molecular weight is $4\times10^6$ minimum, and the specific gravity is 0.940–0.942. This material is sold under various trade names, such as Hi-Fax 1900, Tuflar and Tivar, and is extrudable to the required cross-sectional configuration and surface finish.

The cross-sectional configuration of member 95 of guide means 28 is substantially T-shaped at its upper end, having first and second lateral projections 106 and 108 sized to provide the handrail retaining and guiding functions, and its lower end has an inverted U-shaped configuration. The inverted U-shape is provided by first and second depending leg portions 110 and 112, respectively, which are spaced to define a channel 114. Channel 114 functions to receive the handrail guide support 58, and to also receive the balustrade panels 18.

Leg portion 110 includes an outer surface 116 which extends to deck member 46 concealing a lateral edge of laminate 67. Leg portion 110 further includes a depending lip portion 118 which is sized to snugly extend into the space 120 between end 72 and the stem portion 59 of the upstanding handrail guide support 58. Thus, when guide means 28 is assembled, it is placed over support 58 such that the base portion 60 of the inverted-L configuration fits snugly into a complementary shaped and dimensioned sub-channel in the base of the main channel 114, and with the lip portion 118 extending into space 120. The handrail guide means 28 is then firmly secured in this position by a plurality of spaced drill screws 122 which are placed into a recess 124 formed in the top of member 95 of the handrail guide mans 28. The drill screws are then drilled and screwed through the handrail guide means 28 and base portion 60. This arrangement provides a mechanically strong, rigid structure which resists lateral forces applied against handrail 26 which tend to pivot guide means 28 in a CCW direction, as viewed in FIG. 2.

The second leg portion 112 includes an outer surface 124, with the lower end of leg portion 112 turning slightly inward at 125, in order to provide a narrow pressure line or surface against the balustrade panels 18.

A lower support extrusion member 124 is fastened to the inside of the skirt extrusion 22, and the lower inner deck 20 is fastened to the outer surface of the skirt 22. Deck 20 and support member 124 cooperatively define a groove 126 for receiving the lower edge 21 of the balustrade panels 18.

In the installation of balustrade panels 18, the upper edge 19 of a panel 18 is pressed against the curved spring steel portion 96 of the clips 94 and lifted upwardly into the channel 144 to a point which enables the lower edge 21 of the panel 18 to swing inwardly over the groove 126. The panel 18 is then lowered into the groove. The clips 94 resiliently bias the upper edge 19 of the panel 18 against the lip-like portion 125 of the second leg portion 112, to provide a mechanically strong structure which maintains its assembled relation, even when lateral forces are applied to the panels and/or handrail. Yet, a panel 18 may be quickly and easily removed by authorized personnel, using suction grips.

Figure 6:
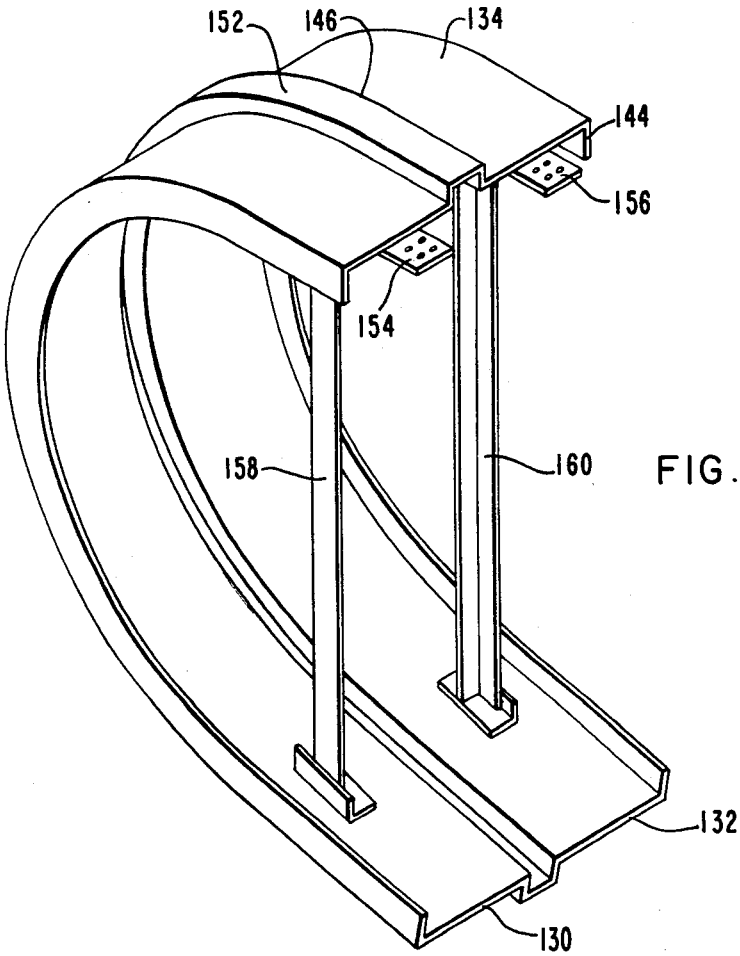
FIG. 6 is a perspective view of right and left hand newel sections during the process of manufacturing them according to a preferred embodiment of the invention.
Figure 5:
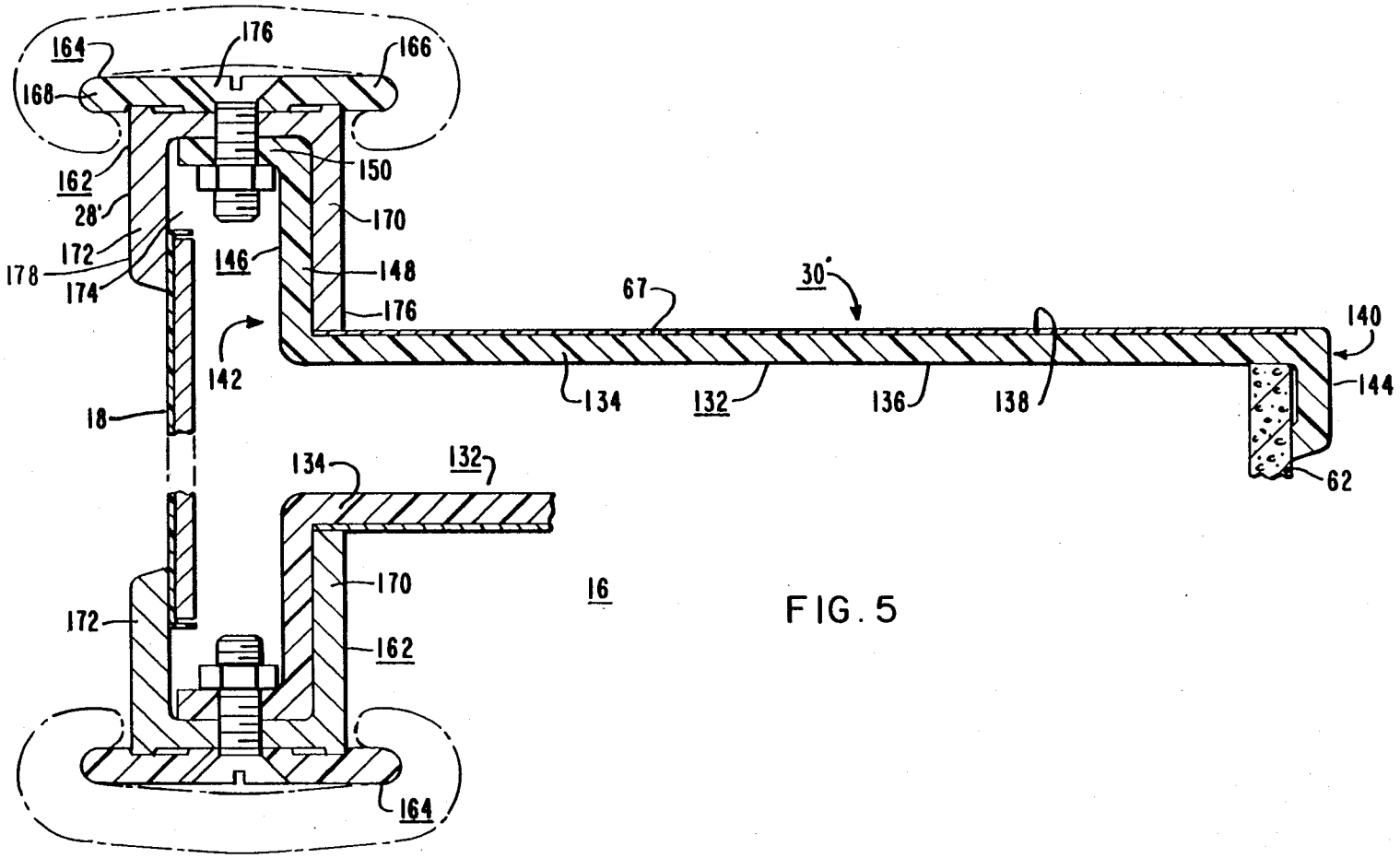
FIG. 5 is a cross-sectional view of a newel section of the balustrade shown in FIG. 1, taken between and in the direction of arrows V—V.

FIG. 5 is a cross-sectional view taken between and in the direction of arrows V—V in FIG. 1, illustrating the newel section 17 of balustrade 16, which is constructed according to the teachings of the invention. FIG. 6 is a perspective view of a non-metallic support or base member of the newel section, illustrating how non-metallic base members 130 and 132 may be made for the right and left hand newel sections at the same time. Both FIGS. 5 and 6 will be referred to interchangeably in the following detailed description of an exemplary embodiment of the invention.

More specifically, the newel section 17 of balustrade 16 includes the handrail guide support structure 30', which, in addition to supporting the second portion 28' of the handrail guide means, functions as a continuation of the upper, outer deck. The non-metallic base member 132 provides a mounting base for the handrail guide 28', and thus must be formed of a strong non-metallic material, such as reinforced fiberglass. Base member 132 includes a major curved base portion 134 defined by curved inner and outer opposed surfaces 136 and 138, respectively, and first and second lateral edges 140 and 142, respectively. The first lateral edge 140 is turned inwardly, away from the inner surface 136, to form an integral right angle flange 144 which overlaps a continuation of wall portion 62. The second lateral edge 142 is formed to define an integral, upstanding handrail guide support 146. Handrail guide support 146, which extends perpendicularly away from outer surface 138, has an inverted L-shaped cross-sectional configuration, including a stem portion 148 and a base portion 150. Handrail guide support 146 continues the handrail guide support 58 of the intermediate section 15. Base member 132 is formed of material having the same color as member 46, in order to provide a continuation of the desired accent line between an end of the outer deck member and the adjacent wall portion 62.

Surface 138 of base member 132 is recessed slightly, in order to receive a continuation of the decorative laminate 67, which is applied and bonded with a suitable adhesive. As hereinbefore stated, the laminate 67 is preferably jointless, extending from end-to-end of each balustrade of the escalator.

As shown in FIG. 6, right and left hand base members 130 and 132, respectively, for right and left hand newels, may be molded simultaneously and subsequently severed along part line 152. Metallic splice plates 154 and 156 are molded to the base members 130 and 132, respectively, for attaching the upper end of each base member to an end of the outer deck portion of the intermediate section 15. Support channels 158 and 160 are fixed to opposite inner sides of each base member 130 and 132, respectively, to provide dimensional stability during handling and shipment. Support channels 158 and 160 may be removed when the base members 130 and 132 are assembled into a balustrade, or they may be retained as part of the support structure 24', as desired.

Since the newel structure described up to this point is formed of a non-metallic material, such as plastic, with no stabilizing metallic member similar to metallic base member 44 of the intermediate section 15, the second portion 28' of the handrail guide means is preferably a composite assembly formed of metal and plastic members 162 and 164, respectively, with the cross-sectional configuration of the composite assembly being similar to that of the first portion 28 of the handrail guide means associated with the intermediate section. The metallic member 162 provides strength and dimensional stability for the associated newel section. The plastic member 164, which is preferably extruded from the same UHMW, high density polyethylene as the extruded member of handrail guide means 28, includes first and second lateral projections 166 and 168 sized to provide handrail retaining and guiding functions.

The metallic member 162, which is preferably extruded from aluminum and painted to be the same color as plastic member of the handrail guide means 28, has an inverted U-shape, including first and second depending leg portions 170 and 172, respectively, which are spaced to define a channel 174. Channel 174 functions to receive the handrail guide support 146, and to also receive a balustrade panel 18.

Leg portion 170 includes an outer surface 176 which extends to base portion 134, to conceal a lateral edge of decorative laminate 67. When guide means 28' is assembled, it is placed over support 146 such that the base portion 150 of the inverted-L configuration fits snugly into a complementary shaped and dimensioned base portion of the channel 174.

The metallic and plastic components of the composite handrail guide means 28' are assembled via a plurality of fasteners, such as nut and bolt combinations 176. This composite assembly of metallic and plastic elements provides a mechanically strong, rigid structure which resists lateral forces applied against handrail 26 which tend to pivot guide means 28' in a CCW direction, as viewed in FIG. 2.

The second leg portion 172 includes an outer surface 178, which overlaps the balustrade panel 18. Suitable biasing means (not shown) may be fixed to support 24', for biasing a balustrade panel 18 outwardly against the second leg portion 172.

In summary, there has been disclosed a new and improved balustrade for transportation apparatus which eliminates the need for an upper inner deck between the handrail and balustrade panels, when the transportation apparatus utilizes opaque panels. Notwithstanding this overhung type of structure, the disclosed upper, outer deck structure and handrail guide and support is a very strong structure mechanically, resisting forces applied to the structure from any direction. The new and improved balustrade includes an intermediate section having an upper, outer deck assembly which is relatively low cost, yet mechanically strong and pleasing in appearance. A hidden structural member of the deck is formed of galvanized steel to provide a mechanically strong, corrosion resistant support base, and an upper structural member which cooperates with the steel base is formed of a plastic member which cooperates with the base to provide a structural beam. A decorative laminate or cladding is applied to the exterior of the plastic member, to provide the desired decorative appearance of the deck, without requiring that the entire exposed deck portion be formed of this material. The new and improved deck is constructed such that it may be field assembled and field formed to the curves of the associated apparatus, such as the curves between the inclined and horizontal portions of an escalator. A new and improved handrail guide support in the form of a plastic extrusion eliminates the need for additional low coefficient of friction strips used in the prior art to contact the inside of the handrail. The side surfaces of the handrail guide support extend to the outer deck on one side, and to the balustrade panels on the other, providing an uncomplicated, pleasing appearance. The balustrade panels may be quickly installed, and just as quickly replaced, by authorized personnel. The new and improved balustrade also includes first and second newel sections at the first and second ends, respectively, of the intermediate section, which continues the low cost, mechanically strong aspects of the intermediate section, with the basic support portion of each newel section being formed of a mechanically strong plastic material.

I claim as my invention:

1. A balustrade, comprising:

upstanding balustrade panels having upper and lower edges, a handrail support and guide structure mounted above the upper edges of said panels, said handrail support and guide structure including an elongated, non-metallic unitary handrail guide member having a cross-sectional configuration which is substantially T-shaped at its upper end, and in the form of an inverted U-shape at its lower end, said substantially T-shaped configuration including a central body portion having first and second side portions which extend outwardly to provide first and second integral, lateral projections sized to support and guide an endless, moving handrail, an endless handrail mounted for movement on said unitary handrail guide member and a lower support structure for receiving the lower edges of the balustrade panels, said inverted U-shaped portion being defined by said central body portion, with its first and second side portions defining the outer surfaces of first and second integral, depending leg portions, spaced to define a channel receiving the upper edges of said upstanding balustrade panels, said unitary handrail guide member being constructed of a self-lubricating plastic material characterized by a coefficient of friction which enables the first and second lateral projections to directly contact the inside of the handrail while it is moving, and eliminate the need for intervening low-friction guide pieces, said handrail support and guide structure further comprising an outer deck which includes a composite assembly comprising a base member and a deck member, said base member including a substantially flat metallic portion having first and second lateral edges, with one of said edges defining an integral, upstanding handrail guide support which extends into the channel defined by the first and second spaced leg portions of said unitary handrail guide member, converging directly under the handrail with the upper edges of said balustrade panels to support said unitary handrail guide member with installation and removal of the balustrade panels being facilitated by the channel structure of the handrail guide member, wherein the channel receiving the upper edges of the balustrade panels is dimensioned to enable the panels to be lifted upwardly into the channel, and then lowered into said lower support structure, with the balustrade panels still being within the channel in their assembled position, with spring means fixed to the base member of the composite assembly, and disposed to bias the balustrade panels during installation of the panels, and against only a predetermined one of the spaced leg portions of the unitary handrail guide member after installation.

2. The balustrade of claim 1 wherein the first leg portion of the unitary handrail guide member is dimensioned to overlap the balustrade panels inserted therein, and the second leg portion is dimensioned to rest upon the deck member.

3. The balustrade of claim 2 wherein the upstanding handrail guide support is spaced from the deck member, and wherein the second leg portion is configured to extend into the space between the upstanding handrail guide support and deck member, as well as to rest upon the deck member.

4. The balustrade of claim 1 wherein the upstanding handrail guide support includes a curved portion, with the upstanding handrail guide support having a plurality of spaced notches, at least adjacent to the curved portion, to facilitate bending the handrail guide support to form the curve.

5. The balustrade of claim 1 wherein the handrail support and guide structure includes:

a newel section, said newel section including a non-metallic base member having a curved base portion having first and second major surfaces and first and second lateral edges, with one of said edges defining an integral, handrail guide support, handrail guide means including a composite assembly comprising a metallic member and a non-metallic member, said metallic member having first and second spaced leg portions which define a channel receiving both the handrail guide support and a balustrade panel, said non-metallic member having first and second lateral projections aligned with the first and second side portions, respectively, of the unitary handrail guide member, and sized to support and guide the handrail, and means fixing said handrail guide means to the handrail guide support of said non-metallic base member.

* * * * *